US008223975B2

(12) United States Patent
Marko

(10) Patent No.: US 8,223,975 B2
(45) Date of Patent: Jul. 17, 2012

(54) METHOD AND APPARATUS FOR MULTIPLEXING AUDIO PROGRAM CHANNELS FROM ONE OR MORE RECEIVED BROADCAST STREAMS TO PROVIDE A PLAYLIST STYLE LISTENING EXPERIENCE TO USERS

(75) Inventor: Paul D. Marko, Pembroke Pines, FL (US)

(73) Assignee: XM Satellite Radio Inc., Washington, DC (US)

( * ) Notice: Subject to any disclaimer, the term of this patent is extended or adjusted under 35 U.S.C. 154(b) by 1044 days.

(21) Appl. No.: 12/213,414

(22) Filed: Jun. 19, 2008

(65) Prior Publication Data

US 2009/0320075 A1 Dec. 24, 2009

(51) Int. Cl.
*H04H 20/47* (2008.01)

(52) U.S. Cl. ..... 381/2; 381/77

(58) Field of Classification Search ..... 381/1, 2, 381/77, 80, 81; 455/3.01–3.06, 12.1–12.3, 455/427–430, 67.11, 66.1; 700/94
See application file for complete search history.

(56) References Cited

U.S. PATENT DOCUMENTS

| | | | | |
|---|---|---|---|---|
| 5,973,723 | A * | 10/1999 | DeLuca | 725/34 |
| 6,694,316 | B1 | 2/2004 | Langseth et al. | |
| 6,876,835 | B1 * | 4/2005 | Marko et al. | 455/3.06 |
| 7,343,179 | B1 * | 3/2008 | Theis et al. | 455/567 |
| 7,720,432 | B1 | 5/2010 | Colby et al. | |
| 7,941,525 | B1 * | 5/2011 | Yavilevich | 709/224 |
| 2002/0032019 | A1 * | 3/2002 | Marks et al. | 455/414 |
| 2003/0014767 | A1 | 1/2003 | Stumphauzer, II | |
| 2003/0115604 | A1 * | 6/2003 | Yamamura et al. | 725/55 |
| 2003/0128774 | A1 * | 7/2003 | Suzuki et al. | 375/316 |
| 2003/0236843 | A1 | 12/2003 | Weber et al. | |
| 2004/0153178 | A1 | 8/2004 | Koch et al. | |
| 2004/0266336 | A1 * | 12/2004 | Patsiokas et al. | 455/3.04 |
| 2005/0249080 | A1 * | 11/2005 | Foote et al. | 369/59.1 |
| 2006/0040609 | A1 | 2/2006 | Petschke et al. | |
| 2006/0123053 | A1 | 6/2006 | Scannell, Jr. | |
| 2007/0014536 | A1 * | 1/2007 | Hellman | 386/94 |
| 2007/0123185 | A1 | 5/2007 | Welk et al. | |
| 2007/0192795 | A1 | 8/2007 | Kellner et al. | |
| 2007/0256100 | A1 * | 11/2007 | Jeong | 725/40 |
| 2007/0277214 | A1 * | 11/2007 | Kim et al. | 725/131 |
| 2008/0019371 | A1 * | 1/2008 | Anschutz et al. | 370/394 |
| 2008/0254751 | A1 * | 10/2008 | Lazaridis | 455/74 |

* cited by examiner

*Primary Examiner* — Cuong Q Nguyen
*Assistant Examiner* — Yosef Gebreyesus
(74) *Attorney, Agent, or Firm* — Roylance, Abrams, Berdo & Goodman, LLP

(57) ABSTRACT

A method and apparatus are provided for generating a personalized radio channel playlist by time division multiplexing songs from multiple received channels from one or more broadcast source streams in a queue. Users specify favorite channels for building personal playlists, or multiple default playlist channels are provided by genre. Thumbs up/down buttons on the radio receiver enter a song or artist being played back into a favorites list used to search all channels for matches or a banned list used to block songs from future playlists. A matched channel carrying the favorite is added to the playlist. Segments on the playlist are dynamically truncated to reduce the average time each segment is played and facilitate preview. Preview times can vary depending on the size of the playlist or number of channels used. Connectivity options and web interfaces facilitate transfer and sharing of customization parameters for personalized radio configuration.

31 Claims, 13 Drawing Sheets

DISPLAY MODE A
(SINGLE SONG)

DISPLAY MODE B
(SONG LIST)

METHOD AND APPARATUS FOR MULTIPLEXING AUDIO PROGRAM CHANNELS FROM ONE OR MORE RECEIVED BROADCAST STREAMS TO PROVIDE A PLAYLIST STYLE LISTENING EXPERIENCE TO USERS

CROSS-REFERENCE TO RELATED APPLICATIONS

Related subject matter is disclosed and claimed in U.S. patent application Ser. No. 09/695,226, filed Oct. 25, 2000 (now issued as U.S. Pat. No. 7,180,917), in U.S. patent application Ser. No. 10/831,343, filed Apr. 26, 2004, in U.S. patent application Ser. No. 11/892,475, filed Aug. 23, 2007, and in U.S. patent application Ser. No. 12/000,198, filed Dec. 10, 2007, the entire contents of which are incorporated herein by reference.

FIELD OF THE INVENTION

The present invention relates to a system and method for providing a broadcast radio service listener with the ability to generate a personalized radio channel playlist on a radio receiver from broadcast content as it is received. More specifically, the present invention relates to a system and method for buffering content from a set of channels selected from among the broadcast channels of a source stream(s) as they are received, and for generating a playback stream using the buffered content that provides a multi-channel listening experience to the user with preview, reverse, fast forward and other navigation functions for the buffered content.

BACKGROUND OF THE INVENTION

On-line personalized radio service has demonstrated its appeal to music fans as evidenced by the continued growth of personalized radio service providers such as Pandora, LastFM and Slacker. These providers assemble personalized playlists for users by accessing a large music library where each song has a metadata field containing ratings on multiple stylistic parameters. A user inputs a preferred music style, and the provider's system extracts songs from the library for the playlist based on correlation to the song metadata field. Advantageously, users are provided with the capability to accelerate their discovery of new content which is largely aligned with their personal preferences, by skipping over content in the playlist which the user finds uninteresting.

A need exists for a personalized radio service using one or more broadcast services that provides personalized and updated content similar to conventional personalized radio services employing large music libraries, and that provides a spontaneous listening experience with greater opportunity for exposure to new music. A need exists for a live satellite radio offering with low cost hardware that does not require a large local song database to be built over time at a satellite receiver by recording content matches received over-the-air or via other broadcast method.

Conventional personalized radio services such as Pandora and Slacker enable users to set up different playlists for different genre preferences such as alternative, classical and comedy, but do not provide the capability to mix diverse personal content preferences into a single playlist. A need exists to expose users to diverse preferred content in a single continuous playlist without requiring manual interaction or forethought to change playlists or channels.

Satellite radio offers more than 100 channels of audio content. After initially exploring the content offering, subscribers typically narrow their listening choices to 10 or fewer favorite channels, which may be any combination of music and talk channels. For example, a subscriber may prefer listening to popular music and may preset 5 or 6 popular music channels on the radio, along with a comedy channel and news channel. With present radio receiver hardware, the subscriber is limited to listening to one channel at a time and therefore misses the opportunity to be exposed to content simultaneously broadcast on the other favorite channels. A need therefore exists for a satellite digital audio radio service (SDARS)-based personal radio service that provides the subscriber with an option to be exposed to content simultaneously broadcast on multiple channels selected for building a personalized radio channel playlist.

In addition, conventional personalized radio services do not carry news, live concerts or sports events which some users might like in a personalized radio channel playlist. A need therefore also exists for an SDARS-based personal radio service that allows the subscriber to select from among the diverse content channels simultaneously broadcast in an SDARS stream to build a personalized radio channel playlist from both music channels and talk channels (e.g., news, sports or comedy channels), the content of which is not typically provided in the on-line libraries of conventional personalized radio service providers.

Conventional personalized radio services are also disadvantageous in that user interaction with a computer is required to build the personalized playlist. A need exists for a personalized radio services that allows users who enjoy listening to music while driving to build a personalized radio channel playlist using a vehicle-installed radio receiver, thereby personalizing their received programming choices.

SUMMARY OF THE INVENTION

Exemplary embodiments of the present invention address at least the above problems and/or disadvantages and provide at least the advantages described below.

In accordance with an exemplary embodiment of the present invention, a method and apparatus (e.g., a receiver) and computer readable code on a computer-readable medium for generating a playlist from one or more received broadcast streams. The playlist is generated by receiving at least one broadcast stream comprising a plurality of multiplexed audio program channels, each of the audio program channels comprising audio segments for reception by all receivers configured to receive the at least one broadcast stream; selecting a set of channels from among a plurality of preconfigured sets of channels, the preconfigured sets of channels comprising selected ones of the audio program channels in the broadcast stream; simultaneously extracting each of the audio program channels in the selected set of channels from the received broadcast stream; and generating a playlist by contemporaneously multiplexing and storing the audio segments in the extracted set of channels as they are received.

In accordance with different aspects of the present invention, the broadcast stream provides several genres of audio programming and several audio program channels for each of the genres. The selected set of channels can comprise a plurality of audio program channels containing audio segments corresponding to the same genre (e.g., same music genre). Alternatively, the selected set of channels can comprise a plurality of audio program channels containing audio segments corresponding to at least two genres (e.g., two different genres selected from music, news, sports, comedy, and talk shows).

In accordance with exemplary embodiments of the present invention, the audio segments in the extracted set of channels are listed in the playlist for playback in the order of the respective start times of the audio segments in the broadcast stream. The audio segments from the extracted set of channels can also be stored from their respective start times to allow playback from the beginning of each of these audio segments.

Navigation control inputs can be provided to allow a user to scroll forward and backward in the playlist to see the currently stored audio segments, and to select and playback the audio segments in the playlist. The user is therefore advantageously exposed to the audio segments in the extracted set of channels even when they are being presented simultaneously in the received broadcast stream.

In accordance with exemplary embodiments of the present invention, the audio segments in the playlist can be automatically played back in a preview mode by playing back truncated versions of the audio segments. Navigation control inputs can provide a user with a control input to select and playback a full length version of one of the audio segments.

In accordance with exemplary embodiments of the present invention, a playlist is generated by buffering the audio segments from the extracted set of channels on a first-in-first-out (FIFO) basis, and managing buffer capacity by overwriting the audio segments in the playlist on a FIFO basis using the audio segments in the set of channels that are currently being extracted from the received broadcast stream. The buffer capacity can be managed by discarding new audio segments in the set of channels that are currently being extracted from the received broadcast stream when the buffer reaches a predetermined threshold of content waiting to be consumed.

In accordance with an exemplary embodiment of the present invention, storing of the audio segments into the playlist can be delayed for a selected period of time following their reception to prevent audio segments comprising any of disc jockey chatter, commercials and undesired content from being stored in the playlist. An audio segment is not stored into the playlist for a selected period of time or for a selected number of audio segments after an equivalent audio segment is determined to already exist in the playlist.

In accordance with exemplary embodiments of the present invention, audio segments in the playlist can be previewed by playing back a truncated version of each of the audio segments. A full length version of a selected previewed audio segment can be played back in response to a user input. The duration of the truncated versions of the audio segments can be varied depending on at least one condition selected from the group consisting of the number of audio segments stored in the playlist, a number of fast forward operations selected by the user during preview, and the rate of the at least one broadcast stream. The titles of the audio segments in the playlist can be displayed, along with a countdown timer indicating the amount of time left during playback of a truncated version of one of the audio segments. An audible alert can be generated at a selected time before the end of playback of a truncated version of one of the audio segments, and a user can be provided with a control input to select and playback a full length version of the audio segment being played back before the end of its preview.

In accordance with exemplary embodiments of the present invention, the received broadcast stream can be a high speed broadcast stream having a baseband rate that is faster than a real-time baseband audio stream rate. The received broadcast stream can be a satellite digital audio radio service (SDARS) stream or a high definition radio broadcast stream. Further, at least one other stream can be received that is selected from the group consisting of a satellite radio broadcast stream, a high speed high definition (HD) radio stream, a real-time HD radio stream, a WiFi stream, and wireless stream. The other stream can comprise at least one audio program channel having audio segments, and the selected set of channels can comprise an audio program channel from the other stream.

In accordance with exemplary embodiments of the present invention, at least one of a title, artist and channel identifier for each of the audio segments in the playlist is displayed. A user can be provided with navigation control inputs to scroll forward and backward in the playlist to see the currently stored audio segments, and to select and playback the audio segments in the playlist. A user can also be provided with a user control input to select and store one of the audio segments in the playlist to a favorite song file in a non-volatile memory.

In accordance with exemplary embodiments of the present invention, a set of channels can be selected based on user inputs indicating preferred audio program channels. The user selected set of channels are then extracted for generating the playlist. Playlist configuration data can be stored comprising at least one of a user selected set of channels, and a playlist of audio segments generated using a user selected set of channels. The playlist configuration data can be transferred between at least two playback devices.

In accordance with exemplary embodiments of the present invention, selected content can be inserted into the playlist among the audio segments from the extracted set of channels. The selected content can comprise commercials. Thus, different tiers of subscription service (e.g., different subscription rates) to receive the at least one broadcast stream can be provided based on the amount of selected content that is inserted into the playlists.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain embodiments of the present invention will be more apparent from the following description taken in conjunction with the accompanying drawings, in which.

DETAILED DESCRIPTION OF THE EXEMPLARY EMBODIMENTS

Several exemplary embodiments of the present invention are described herein. Briefly, the present invention provides a radio receiver configured to receive at least one broadcast stream comprising a plurality of different content channels. The radio receiver selects multiple channels from among the plurality of broadcast channels and buffers content from the selected channels as they are received simultaneously via the received broadcast stream(s). The buffered content is used to generate a personalized radio channel playlist that gives a listener a personalized, multiple-channel listening experience.

In accordance with one embodiment of the present invention, the multiple selected channels are preselected and stored at the receiver (e.g., plural channels that provide a selected genre of music) to automatically generate a personalized playback channel for the user without the user having to enter specific channels via a user interface on the receiver. In accordance with another embodiment of the present invention, the multiple selected channels are specified by the user (e.g., a combination of favorite music channels and a news channel or comedy channel) via the receiver or another device that interfaces with the receiver. The channels in the broadcast streams can be transmitted at a real-time rate, or can be provided as fast channels that are broadcast at a rate that is n times faster than the real-time rate, which builds a buffer of personalized content at a rate faster than real-time rate. Additional embodiments of the present invention pertaining to buffer management, playlist navigation and management, customization and connectivity features, and content insertion are described below.

The exemplary embodiments are described herein with respect to a satellite digital audio radio service (SDARS) that is transmitted to the receivers by one or more satellites and/or terrestrial repeaters. It is to be understood that the source content stream(s) used to create a personalized radio channel playlist in accordance with the present invention can be broadcast using other content systems (e.g., other digital audio broadcast (DAB) systems or high definition (HD) radio systems), as well as other wireless or wired methods for signal transmission.

Figure 1:
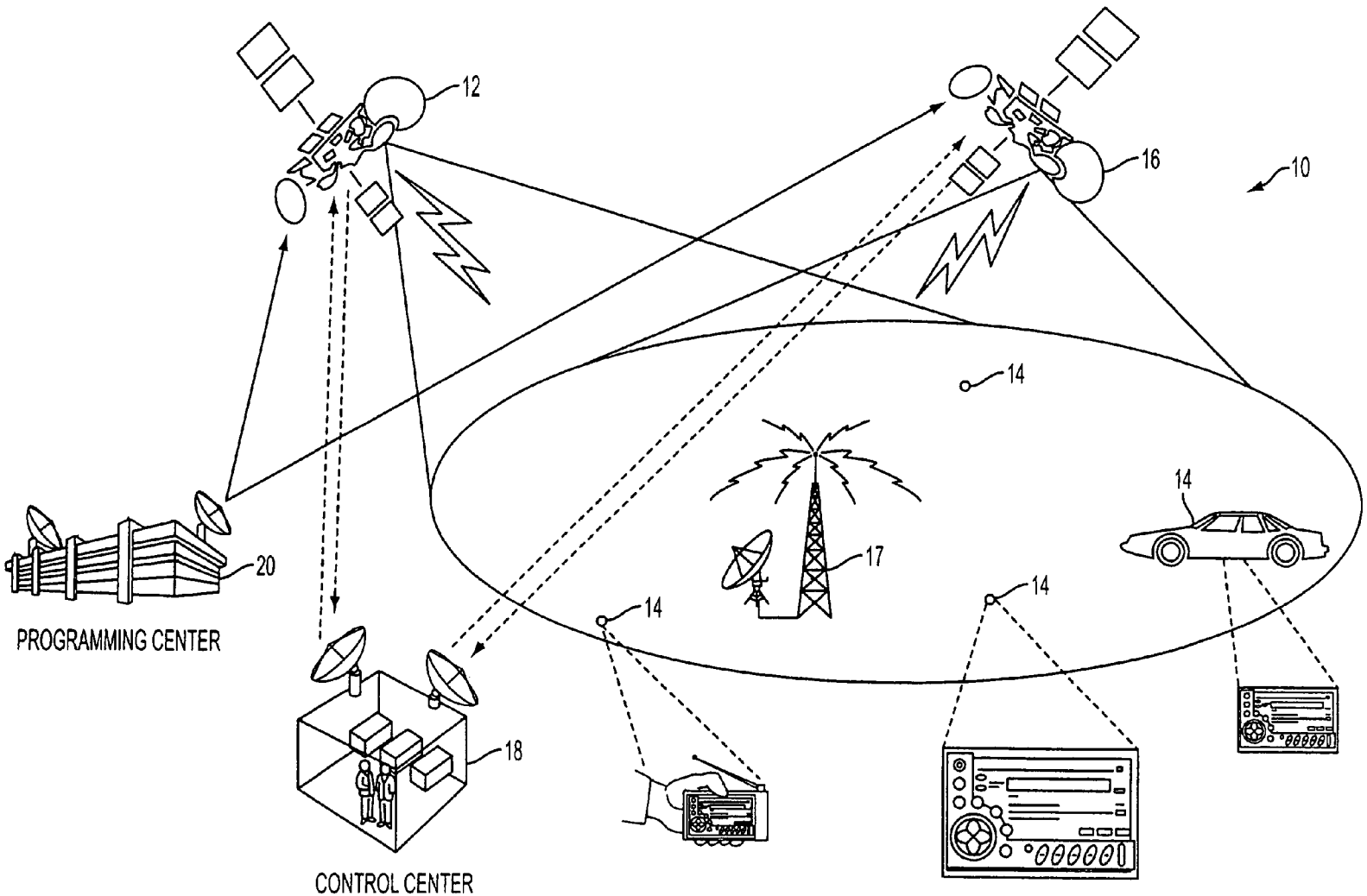
FIG. 1 depicts a multiplexed uplink broadcast transmission system for providing radio receivers with broadcast program channels from which to build personalized radio channel playlists in accordance with an exemplary embodiment of the present invention.

FIG. 1 depicts an illustrative system for transmitting at least one exemplary source stream to radio receivers 14. In the illustrative embodiment, the source stream provides SDARS.

FIG. 1 depicts a satellite broadcast system 10 which comprises at least one geostationary satellite 12, for example, for line of sight (LOS) satellite signal reception at receiver units indicated generally at 14. The satellite broadcast system 10 can be used for SDARS, for example. Another geostationary satellite 16 at a different orbital position is provided for diversity purposes. One or more terrestrial repeaters 17 can be provided to repeat satellite signals from one of the satellites in geographic areas where LOS reception is obscured by tall buildings, hills and other obstructions. It is to be understood that different numbers of satellites can be used, and that satellites in other types of orbits can be used.

As illustrated in FIG. 1, a receiver unit 14 can be configured for stationary use (e.g., on a subscriber's premises), or mobile use (e.g., portable use or mobile use in a vehicle), or both. A control center 18 is provided for telemetry, tracking and control of the satellites 12 and 16. A programming center 20 is provided to generate and transmit a composite data stream via the satellites 12 and 16 which comprises a plurality of payload channels and auxiliary information.

With reference to FIG. 1, the programming center 20 is configured to obtain content from different information sources and providers and to provide the content to corresponding encoders. The content can comprise both analog and digital information such as audio, video, data, program label information, auxiliary information, and so on. For example, the programming center 20 can provide SDARS having on the order of 100 different audio program channels to transmit different types of music programs (e.g., jazz, classical, rock, religious, country, and so on) and news programs (e.g., regional, national, political, financial, sports). The SDARS can also provide emergency information, travel advisory information, educational programs, and the like.

Figure 2:
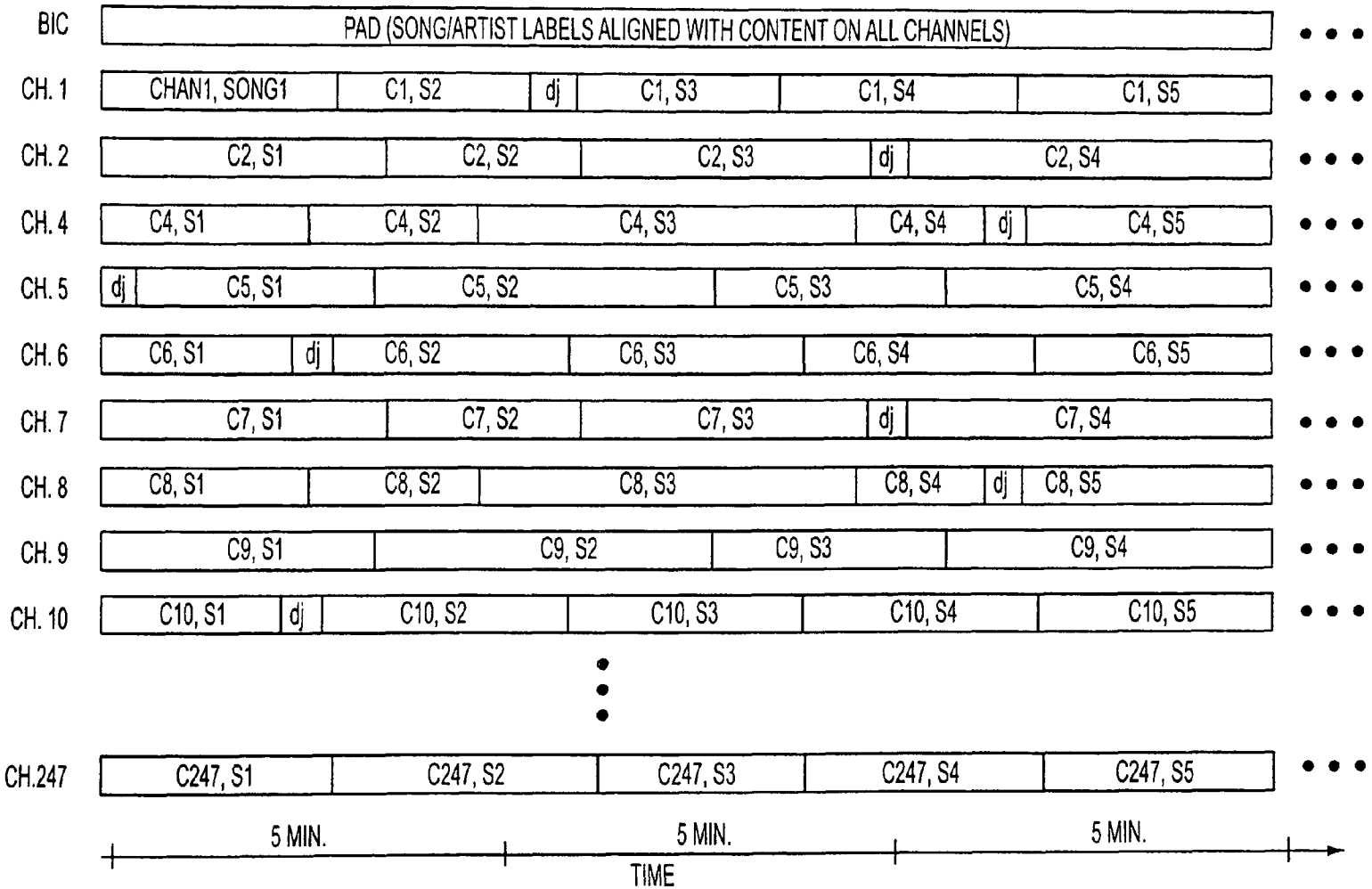
FIG. 2 depicts different program channels in a source stream from which channels can be selected or monitored for favorite content to build personalized radio channel playlists in accordance with an exemplary embodiment of the present invention.

FIG. 2 illustrates different service transmission channels (e.g., Ch. 1 through Ch. 247) providing the payload content and a Broadcast Information Channel (BIC) providing the auxiliary information. These channels are multiplexed and transmitted in a composite data stream that can be a source stream for a radio receiver 14 constructed in accordance with exemplary embodiments of the present invention. The illustrated payload channels comprise segments such as songs indicated, for example, as S1, S2, S3 and so on) and disc jockey (DJ) talk segments indicated as "dj" in FIG. 2.

The BIC includes auxiliary information useful for services selection and non-real-time control. The present invention is characterized by the additional advantages of leveraging this auxiliary information, which is already available in an SDARS composite data stream, for additional beneficial uses. First, the auxiliary information comprises data (e.g., Program Associated Data (PAD) described below) to facilitate locating the beginnings of songs for buffering and locating dj segments for exclusion from the personalized channel. Second, the auxiliary information in the composite data stream (e.g., PAD) allows a multi-channel demultiplexer in the receiver 14 to locate and buffer the selected channels, as well as favorite songs from other non-selected channels. The auxiliary information also allows a multi-channel demultiplexer in the receiver 14 to exclude from the personalized channel any disliked songs identified by the listener. The auxiliary information that relates music genres, channels and songs/artists in an SDARS is therefore a readily available tool with which to navigate the diverse content provided via SDARS for achieving a personalized listening experience. By contrast, extensive metadata must be procured by providers of conventional personalized radio services to enable selection of content for a listener.

More specifically, the BIC can be used to display the station name of available services, a directory to the contents of the composite data stream, as well as PAD. PAD can comprise data associated with a channel such as a song name or label, artist name or label, service ID (SID), and program ID (PID), among other data. The service ID is an identifier (typically 8 bits) which is associated with a specific SDARS provider radio service (e.g., for XM Satellite Radio, the SID can identify service channels such as Top Tracks, CNN News, The Comedy Channel, and the like) and is used identify the specific service channel at the receivers 14. The program ID comprises data relating to the identity of a unique content segment such as a song on a specific CD, for example. Thus, a change in PID and/or PAD can indicate to a receiver 14 the beginning of a song for that channel and facilitate buffering of the song for the personalized radio channel.

The present invention is advantageous since the channels are partitioned into segments, and the beginnings of segments in the multiple selected channels are located for buffering to generate the personalized channel. Thus, complete segments or songs are buffered for playback on multiple, simultaneously received channels that have been selected to create the personalized radio channel playlist. This is in contrast with scanning operations on conventional radios that often bring a listener to the middle or near end of a song that had not been buffered.

Figure 3:
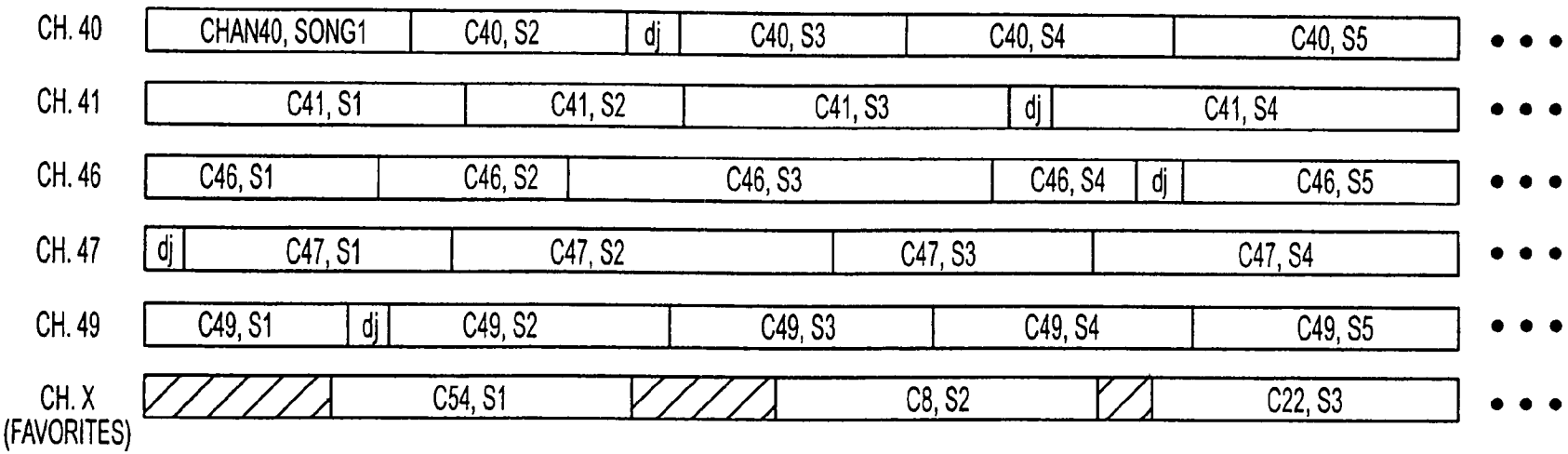
FIG. 3 depicts five exemplary simultaneously broadcast channels (e.g., Ch. 40, Ch. 41, Ch. 46, Ch. 47 and Ch. 49) selected to build a personalized radio playlist and monitored and extracted favorite segments from non-selected channels from one or more source streams for building the personalized radio channel playlist in accordance with an exemplary embodiment of the present invention.

FIG. 3 depicts five exemplary simultaneously broadcast channels (e.g., Ch. 40, Ch. 41, Ch. 46, Ch. 47 and Ch. 49) from one or more source streams. In accordance with an exemplary embodiment of the present invention, the five channels are selected for essentially simultaneous extraction from the received source stream(s) and buffering in a memory 70 (e.g., a static random access memory (SDRAM)) in the radio receiver 14 for creating a personalized radio channel playlist. It is to be understood that a larger or fewer number of channels can be used to create the personalized radio channel playlist.

As stated above, one (or more) of extracted and buffered channels can optionally be a favorite channel. More specifically, the radio receiver 14 is programmed to receive user inputs indicating favorite songs or artists and to save some of the auxiliary information for those songs and/or artists as user favorites data. For example, as described below, a radio receiver 14 can be provided with a Thumbs Up button 32 that a user can depress while listening to a song. The radio receiver 14, in turn, stores user favorites data comprising artist and/or song information obtained from the BIC pertaining to that song. In accordance with an exemplary embodiment of the present invention, the radio receiver 14 monitors the BIC of the received stream(s) for content matching the user favorites data and then extracts and buffers the content for building the personalized radio channel playlist. The monitored channels encompass non-selected channels for the purpose of building the playlist and therefore increase the user's exposure to desirable content in the received source stream to beyond the selected multiple channels.

Figure 4A:
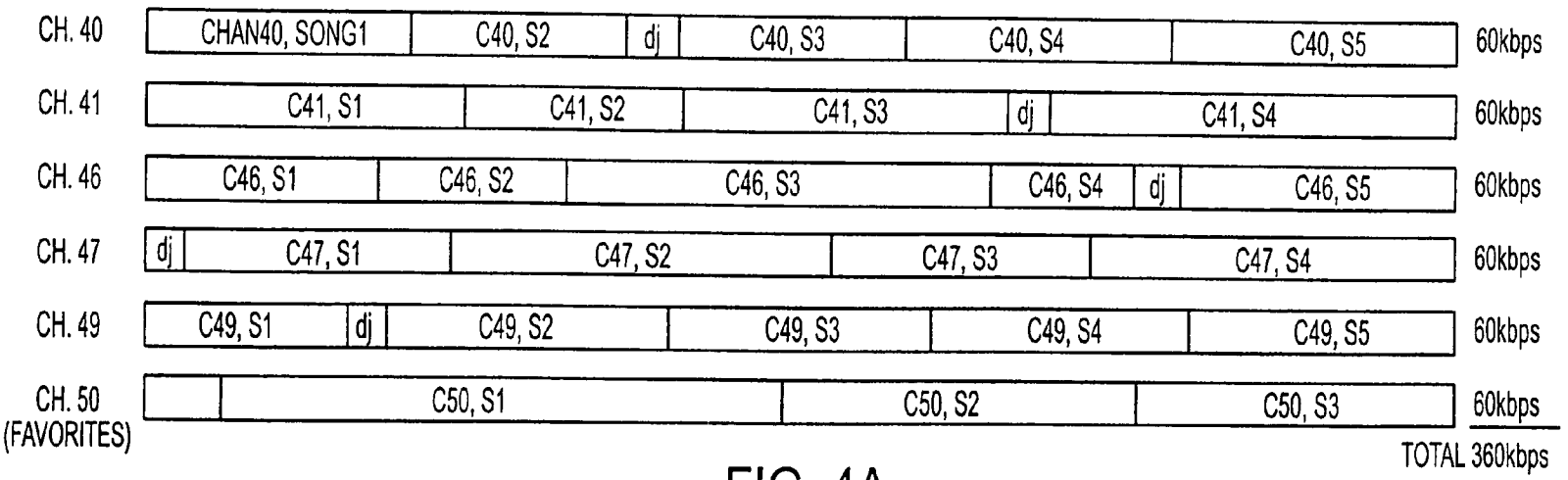
FIG. 4A depicts six selected channels for building a personalized radio channel playlist along with the respective stream bit rate for each channel, which are essentially the same group of channels described with reference to FIG. 3 with the exception of a Ch. 50 being extracted in lieu of implementing a favorites channel (CH. X) in accordance with an exemplary embodiment of the present invention.
Figure 4B:
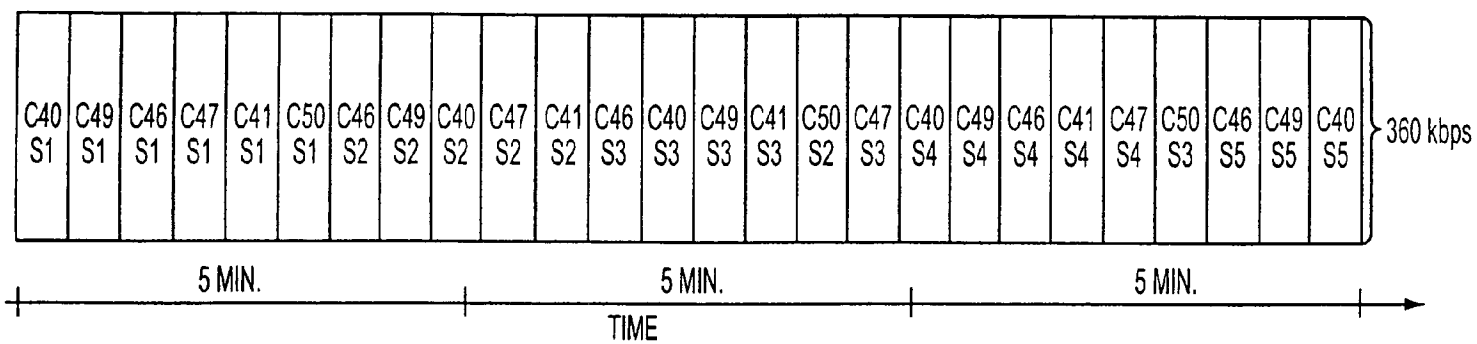
FIG. 4B depicts a high speed stream (e.g., 360 kbps) constituted by songs from multiple channels that are transmitted faster than real-time (e.g., 6 times faster than 60 kbps) in accordance with an exemplary embodiment of the present invention.

FIG. 4A depicts six selected channels for building a personalized radio channel playlist, which are essentially the same group of channels described with reference to FIG. 3 with the exception of a Ch. 50 being extracted in lieu of implementing a favorites channel. With regard to FIG. 4A, a playlist is derived from simultaneous reception of 6 real-time music streams. In the illustrated embodiment, the real-time streams are each 60 kilobits per second (kbps) for a total of 360 kbps of content from which to generate a playlist. Alternatively, the source stream can be a high speed stream (e.g., 360 kbps) constituted by songs from multiple channels that are transmitted faster than real-time (e.g., 6 times faster than 60 kbps), as shown in FIG. 4B.

Figure 5:
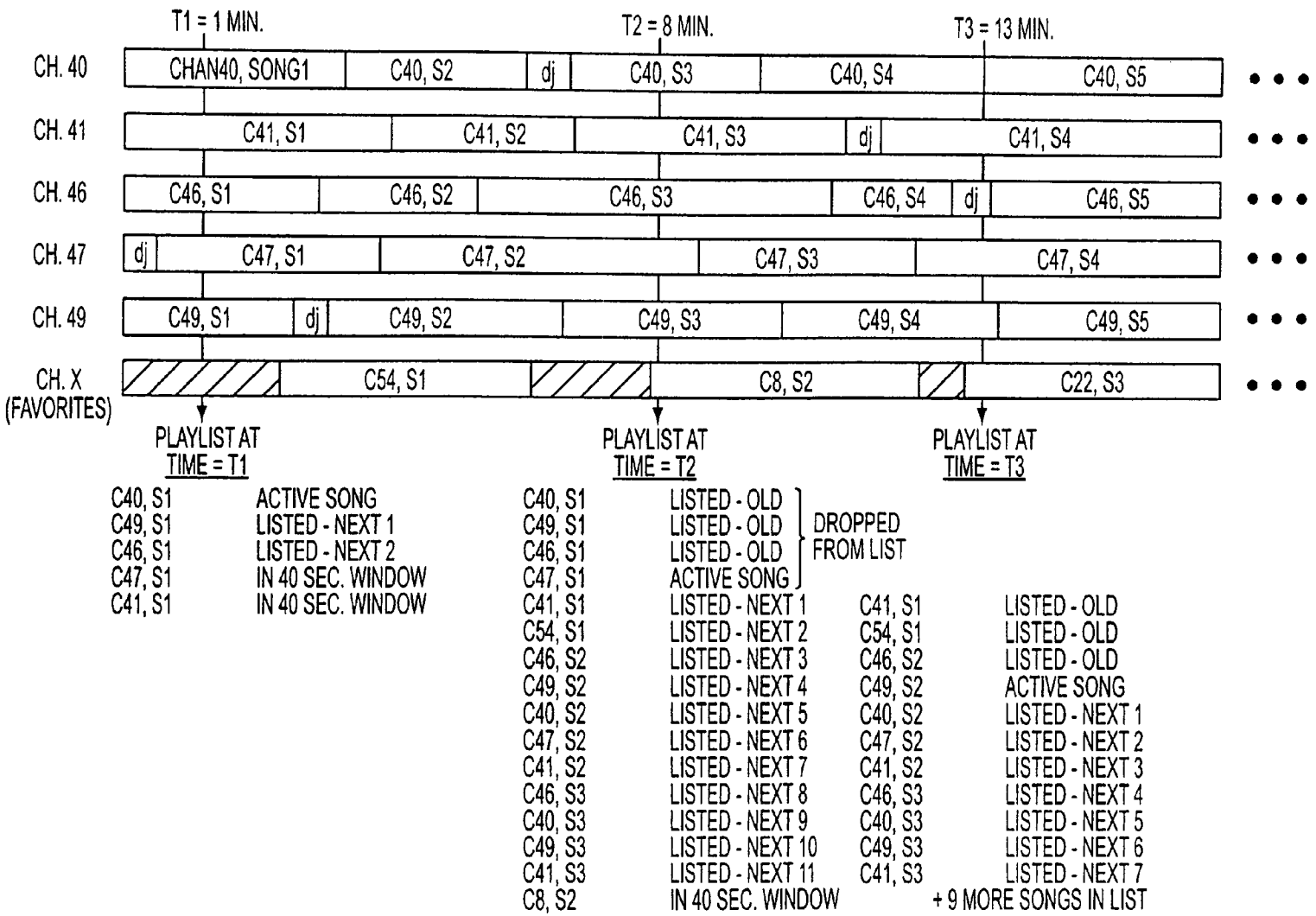
FIG. 5 depicts an illustrative playlist and its constituent selected channels at different times after power up of the radio receiver or selection of a different personalized radio channel configuration in accordance with an exemplary embodiment of the present invention.

In accordance with an exemplary embodiment of the present invention, the personalized channel playlist is generated by time division multiplexing the songs from up to six channels, for example, which enables the playlist to grow faster than real-time. FIG. 5 depicts the playlist at different times after power up of the radio receiver 14 or selection of a different personalized radio channel configuration (e.g., at one minute (T1), at 8 minutes (T2) and after 13 minutes (T3)). The radio receiver 14 preferably monitors the BIC for song or segment changes to locate the beginnings/ends of the songs/segments before buffering. As illustrated in FIG. 5, songs/segments are preferably buffered in the sequential order of their respective start times within the channels being buffered. Further, the radio receiver 14 is programmed to wait a selected time period (e.g., 40 seconds) after the start of a segment before buffering to determine (e.g., from the BIC) whether that segment contains DJ chatter or other content to be ignored and not added to buffer. For example, the radio receiver 14 can be configured to determine that a PAD label for a segment indicates that segment to be a song as opposed to a commercial that is ignored. As shown at time T1, the songs S1 on respective ones of channels Ch. 49 and CH. 46 are listed in sequential order in accordance with their start times following the active Song 1 on Ch. 40. The songs S1 on channels Ch. 47 and 41, however, are preferably not queued in the buffer until about 40 seconds after their start times. Not including short audio segments in the playlist provides one method to remove DJ chatter, commercials or other undesired content.

Assuming that radio receiver 14 start up has occurred or another personalized radio channel configuration has been selected just prior to T1, Song 1 on Ch. 40 has the first start time, followed by Song 1 on Ch. 49 and so on. These songs are preferably buffered by the radio receiver 14 in that order. Thus, at power on, the radio receiver 14 looks for a label change to indicate the start of a song on one of the multiple selected channels and begins building buffered playlist. After power down, the buffer is preferably erased. A flash memory 78 can be used to store buffered playlist segments from the most recent past use for retrieval at power up. A user can switch to another personalized radio channel configuration and start buffering for that selected configuration immediately without a power down operation. The newly buffered segments will overwrite those segments extracted using the previous personalized radio channel configuration.

With continued reference to FIG. 5, the buffered songs that constitute the personalized radio channel playlist are preferably added and dropped on a first-in-first-out (FIFO) basis. As stated above, at playlist start-up (i.e., at power up or initialization of a new playlist configuration, the radio receiver 14 will monitor for the first song/segment with the first start time after start up and then begin building the playlist buffer). As indicated at time T3 in FIG. 5, several of the songs that were available in the playlist at time T2 have been fully or partially played and subsequently dropped at time T3 and more songs have been added.

Figure 6:
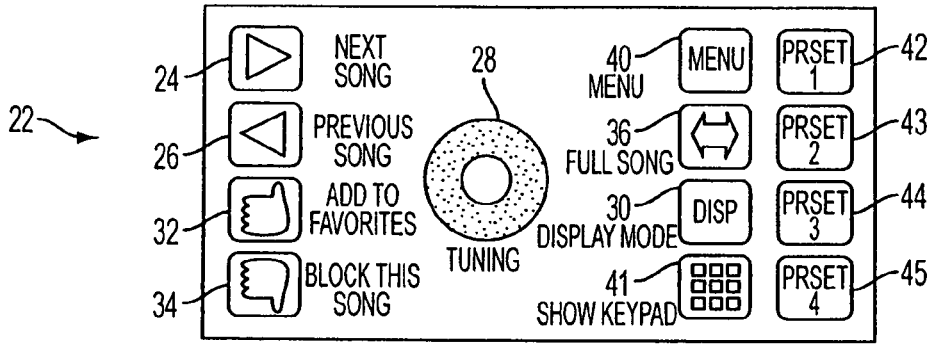
FIG. 6 is an exemplary control interface on a radio receiver that provides navigation tools to see playlist song titles on a display and reverse and fast forward through the playlist, preview functions to optionally play shortened segments of each song/segment or the full-length song/segment, and user control inputs to specify favorite or banned items to be included or excluded from playlists in accordance with an exemplary embodiment of the present invention.
Figure 7:
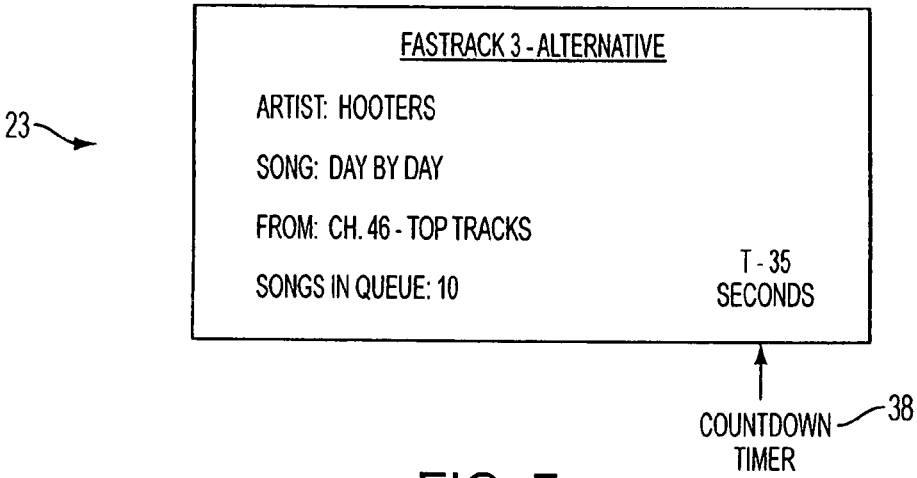
FIGS. 7 and 8 are exemplary displays on a radio receiver for viewing playlist information in accordance with an exemplary embodiment of the present invention.
Figure 8:
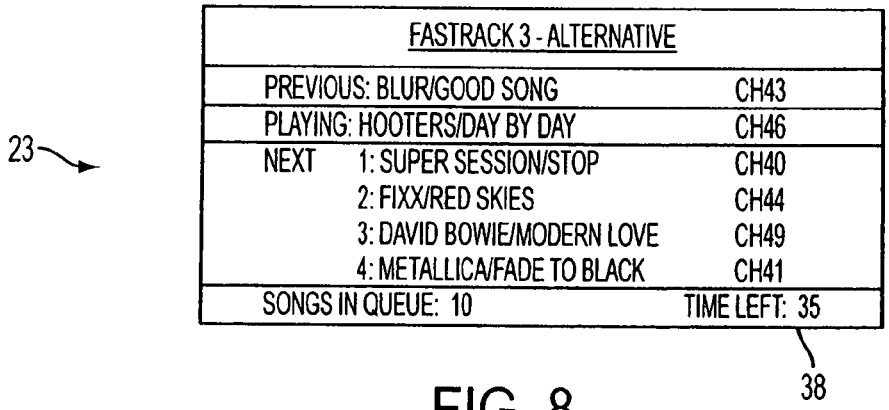

With reference to FIGS. 6, 7 and 8, the radio receiver 14 provides the user with the tools to see playlist song titles on a display 23, with preview functions to optionally play shortened segments of each song/segment or the full-length song/segment, and user control inputs to reverse and fast forward through the playlist. The exemplary control/user interface 22 depicted in FIG. 6 can be configured as soft keys and/or fixed keys on the radio receiver 14. Two exemplary display screens are depicted in FIGS. 7 and 8, respectively, for providing a single song data display screen and a song list display screen on a radio receiver display 23. The screens depicted in FIGS. 7 and 8 preferably constitute Display Modes A and B, respectively. Both Display Modes A and B provide common information such as the name of the personalized radio channel playlist, the channels from which the playlist content is extracted, playlist song titles and artists, the number of songs in the buffer queue, and the duration of time left before the song currently being played back to the user is changed. The Display Mode A displays the same information regarding the currently playing song in a larger format.

The song list display screen in FIG. 8 lists the song from the personalized radio channel playlist that is currently being played back to the user, as well as the previous song in the buffer and the next few songs in the buffer. The control interface 22 shown in FIG. 6, preferably comprises a next song button 24 and a previous song button 26 for scrolling through the list of songs shown on the song list screen of FIG. 8. Since the number of queued songs may be too large for listing in one display screen, the tuning dial 28 can be programmed to permit a user to change the display of queued songs (e.g., scroll through the next songs in the queue after or before the six songs listed in the screen shown in FIG. 8 depending on which direction the dial 28 is turned).

As discussed in connection with FIG. 5, the playlist is continually changing over time as more songs from the selected channels are added to the buffer and previously buffered songs are dropped from the buffer on a FIFO basis. Thus, the number of songs that can be skipped in the reverse direction on the playlist is limited (e.g., as many a three songs) as these songs are overwritten in the buffer. Nonetheless, the reverse operation of the radio receiver 14 is an improvement over conventional on-line personalized radio services that do not permit reverse or back up operations to play prior items on a generated playlist during preview, nor during full playback without first purchasing the item.

With continued reference to the control interface 22 illustrated in FIG. 6, a display mode button 30 is provided to toggle between the different display mode screens (e.g., between a Display Mode A as shown in FIG. 7 and a Display Mode B as shown in FIG. 8) to display all songs in the buffer or current song being previewed or listened to in full. Buttons are also provided to allow a user to indicate, when listening to a song being played back by the radio receiver 14, that the song should be added to the user favorites data for monitoring and extraction via a favorites channel as described above, or be blocked from being queued in the playlist. Thus, the user can employ the "Thumbs Up" and "Thumbs Down" buttons 32, 34 to build a filter using customer-created lists of favorite songs or artists when generating a personalized radio channel playlist at the radio receiver 14.

In order to expose the user to each song being played on the subset of channels in the currently selected personalized radio configuration, songs or talk segments in the buffered playlist are truncated in order to reduce the average time each segment is played. For example, if the playlist has grown to 10 or more songs, each new song may be played for 45 seconds and then terminated so that the next song in the playlist can start. During the song, the user has the option to listen to the full song or back up in the playlist to listen to a previous song. A button 36 is provided to enable a user to select playback of a full-length version of the currently playing song. The user may be provided with an audible alert around 5 or 10 seconds before a song is terminated as a reminder to select playback of the full length version if desired. A user can opt to play full-length versions of all songs in the playlist but would either lose buffered content that is replaced with new content before being previewed or lose new content that could not be buffered when the buffer is full, depending on the buffer management implementation. When playing the full length version of the song, the user may optionally save the song to a separate favorite song file in non-volatile memory (not shown).

As shown in FIGS. 7 and 8, the amount of time left in a currently playing song (i.e., for preview or full length playback) is provided as a countdown timer 38 on the display 22 to inform a user of the time remaining before the current song is truncated and playback of the next song in the queue begins. As described in more detail below, an algorithm for the countdown timer 38 can be a phase locked loop to ensure a selected number of songs remain in the buffer. For example, timer 38 can be speed up (e.g., less preview time per stored segment) when the buffer has grown to a selected amount or the number of channels used to create the personalized radio channel has increased (e.g., using 10 channels instead of 5), or slowed down (e.g., more preview time per stored segment) when a selected number of Fast Forward operations have occurred. This countdown function 38, which truncates the songs in the playlist for preview purposes, may be enabled and disabled by the subscriber.

For example, once the number of "next songs" (e.g., see songs queued after an active song in FIG. 5) in the buffer builds to a predetermined number of songs (e.g., 10 songs), the countdown timer 38 in the radio receiver 14 is initiated. If the number of channels is 5 and the average song is 3.5 minutes, the initial value of the countdown timer can be 210 seconds/5=42 seconds. This value may be set to a predetermined or otherwise fixed value or, as discussed previously, increased and decreased as the number of next songs in the buffer decreases or increases above or below predetermined thresholds. The time value is adjusted in order to maintain a predetermined number of next songs in the buffer.

In order to stop occasional repetition (e.g., buffering the same song being played on different channels), a duplicate filter can be deployed in accordance with an exemplary embodiment of the present invention. Each time a song is listed in the playlist, the same song is added to a blocked song list stored in the radio receiver 14 for the next 10 songs or other predetermined number of songs. This insures at least 10 different songs are presented in the playlist between any 2 repeated songs.

With continued reference to FIG. 6, a menu button 40 provides a user with other functions such as, for example, a purchase button for initiating a transaction to acquire a song in the playlist. The exemplary control interface 22 depicted in FIG. 6 can also have PreSet keys 42, 43, 44, 45 for selecting channels for individual playback or for selecting other multi-channel configurations. A Show Keypad button 41 can also be provided to display numeric soft keys to provide a user with a convenient method of entering numeric information such as a desired channel number.

As stated above, an exemplary embodiment of the present invention uses selected content from a broadcast stream (e.g., satellite or terrestrial delivery) based on personalized settings to build a local personalized content database, that is, a user selects multiple channels from among all of the channels that are broadcast simultaneously in a source stream for simultaneous buffering in a personalized radio channel playlist in a radio receiver 14. Thus, a user is exposed to the content on the multiple channels as it is received.

Another embodiment of the present invention provides for the autogeneration of a personalized radio channel playlist based on selection of one of several offered genre-based multiple-channel personalized radio configurations. For example, the different genre-based multi-channel personalized radio configurations can be broadcast in a control data channel that is separate from the individual audio channel streams, where each configuration includes a list of individual channels for the radio receiver 14 to simultaneously extract. These preset configurations are presented to the subscriber as special "fast track" channels, such that the subscriber can "tune" to them without requiring additional interaction. A user can change between personalized radio configurations and the radio receiver 14 will immediately commence buffering based on the channels in the newly selected personalized radio configuration without requiring a power down operation.

In addition, an embodiment of the present invention allows a user to select which channels are to be included in a customized personalized radio configuration as opposed to using a preset configuration. One of the selected channels in the configuration can be a favorites channel, that is, songs or segments that are extracted from non-selected channels because they have been identified by the user as a favorite (e.g., using the thumbs up button 32 during a previous reception of the song or segment) and stored in a favorites list at the radio receiver 14. The radio receiver 14 is also configured to allow users to specify their favorite channels for building personalized radio channel playlists.

Figure 9:
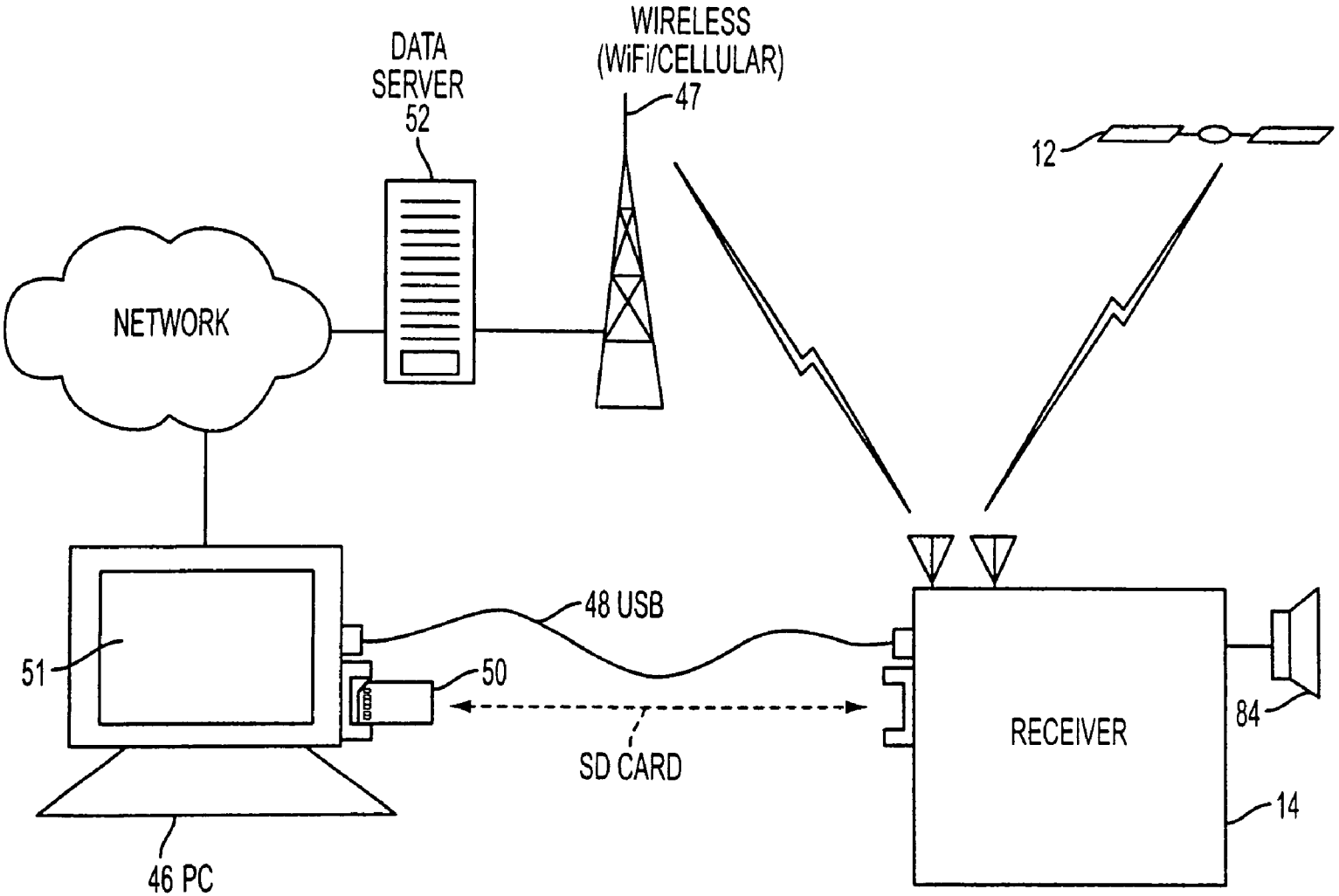
FIG. 9 depicts different optional methods for connecting a radio receiver having a multi-channel memory for buffering personalized radio channel playlists to other computing devices in accordance with an exemplary embodiments of the present invention.

Users have the options of entering favorite song/segment and/or channel information via the user interface 22 on the radio receiver 14 or via a personal computer 46 to which the radio receiver 14 can be connected in accordance with other embodiments of the present invention that facilitate customization of personalized radio channel configurations and sharing of customized playlist building configurations and favorites information (e.g., with friends and family members who enjoy similar broadcast content and may want to build similar personalized radio channels). With reference to FIG. 9, a radio receiver 14 having a multi-channel memory for buffering a personalized radio channel playlist is shown connected to a computing device 46 (e.g., a personal computer (PC)) using a number of different methods. The radio receiver 14 can transfer personalized radio channel configurations, lists of favorite channels, lists of favorite or banned songs and other multi-channel customization parameters to the computing device and receive similar information therefrom using one or more of these methods.

For example, a direct USB connection 48 can be provided between the radio receiver 14 and the PC 46. This is particularly useful if the radio receiver 14 is portable. A radio receiver 14 that is a dedicated car-installed unit can have a removable flash memory card 50 (e.g., a micro SD card) on which customized personalized radio configuration information is stored and corresponding interface. The micro SD card can then be used with a PC 46 or other car-installed radio receiver 14. Further, wireless technology 47 such as WiFi, WiMax and cellular interfaces can be used to call a radio receiver 14 with customized personalized radio information, and to scan and receive the configuration information for uploading through the wireless-enabled radio receiver 14 to a PC 46 or other player. The radio receiver 14 can optionally be connected wirelessly to a server 52. The channel configurations can be transferred or synchronized between the PC 46 and the radio receiver 14 as needed.

Figure 11:
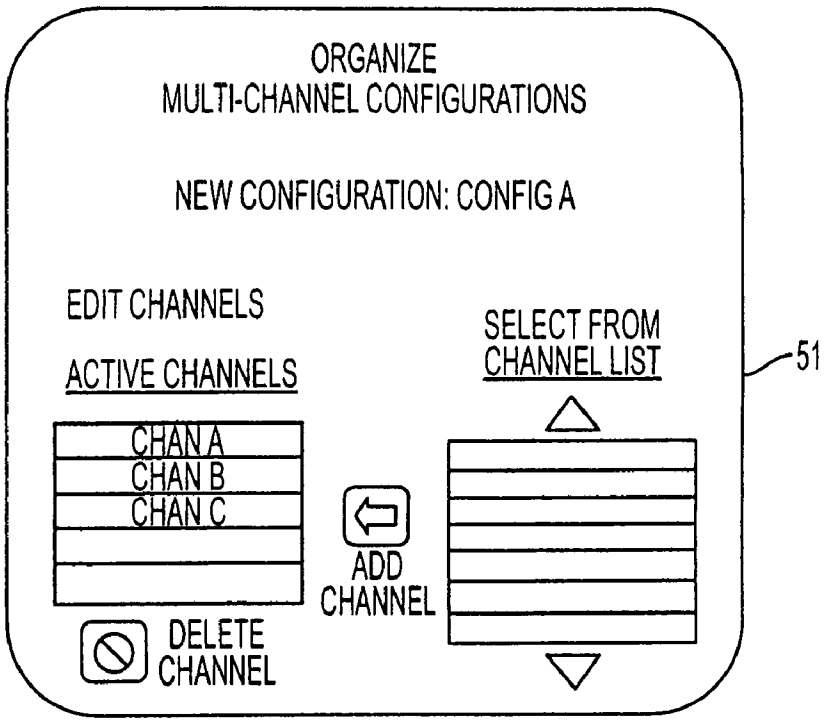
FIGS. 10 and 11 are illustrative web interface window for customization of personalized radio configuration parameters in accordance with an exemplary embodiment of the present invention.
Figure 10:
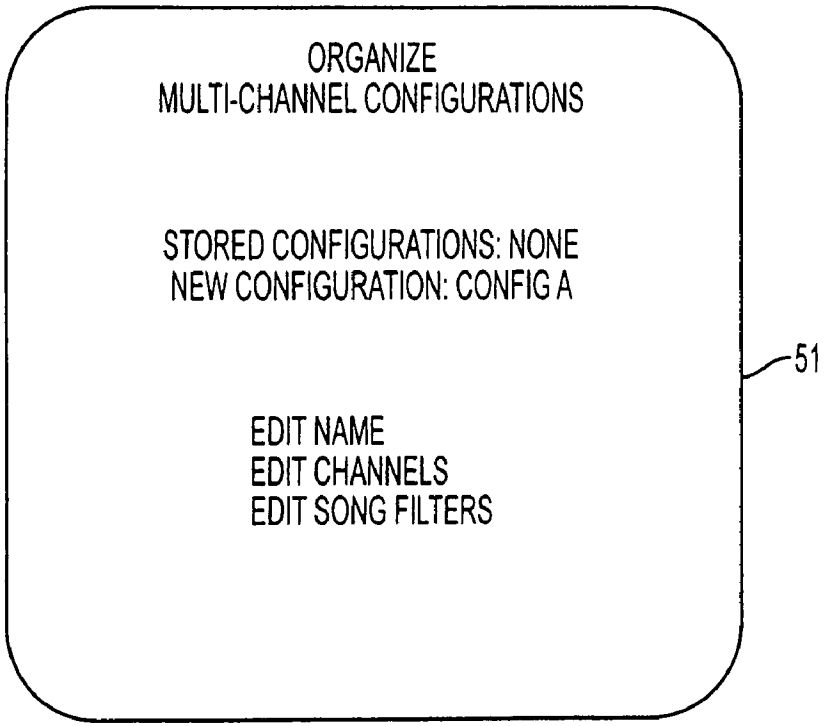

In accordance with another embodiment of the present invention, a web interface can be provided with user screens to allow users to create configurations and lists of favorite artists and songs for building a personalized radio channel that can be transferred to a device using, for example, a direct USB interface 48 or microSD card 50 or other portable memory device. FIGS. 10 and 11 are exemplary PC multi-channel customization screens or a PC display 51. FIG. 10 depicts a "Main Configurations" window that lists any currently stored personalized radio channel configurations and options for creating a new configuration (e.g., edit name, edit channels that constitute the new configuration, and edit song filters). FIG. 11 is an "Edit Channels" window that is displayed when the Edit Channels option is selected in the window depicted in FIG. 10. Active channels can be selected from a scrolling channel list that can include all broadcast channels in a source stream or favorite channels stored in the radio receiver 14. It is to be understood that other source streams can be selected from which channels can be selected and added to the active channels list.

An "Edit Song Filters" window (not shown) can be displayed when the Edit Song Filters option is selected in the window depicted in FIG. 10. The "Edit Song Filters" window is similar to the "Edit Channel" window in FIG. 11 in that the user may select specific songs or artists from a comprehensive list to add to either the "Favorites List" or the "Do Not Play List". As described above, the "Favorites List" is used for a background scan of all non-selected channels and, if a match is found, that song or artist is extracted and added to the playlist. The "Do Not Play List" filters the listed songs or artists out of the playlist.

In accordance with another embodiment of the present invention, the web interface can be used to provide listener's audit information to the programming center 20. For example, patterns of listeners can be determined based on their selected configurations (e.g., music-genres, thumbs up/down operations 32, 34 and corresponding favorites and banned segments lists) which can be uploaded from their PCs 46 to the programming center 20 via the web.

Figure 12:
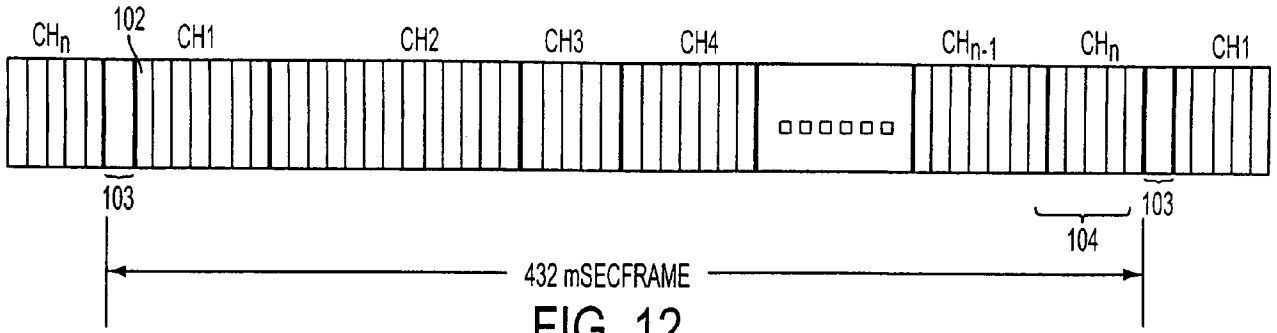
FIGS. 12, 13 and 14 are respective air interface formats for providing a source stream to a radio receiver in accordance with an exemplary embodiment of the present invention.

As stated above, the present invention allows users to build personalized radio channel playlists from selected channels in one or more broadcast source streams such as an SDARS transmission. FIG. 12 depicts an exemplary over-the-air protocol frame format for an illustrative source stream in which the payload channels and auxiliary information channel(s) are multiplexed for transmission to receivers 14. This frame format is based on a 432 millisecond frame where each frame includes a frame header 103 and is subdivided into 8 kilobit per second sub-channels 102. These sub-channels 102 can be dynamically grouped to form higher bit rate payload channels 104 (i.e., Channels 1 through n which may include the BIC). The payload channel 104 provides the necessary bandwidth to transport a high-quality digital audio signal to the listener. When a listener changes program channels on a receiver 14, the receiver 14 extracts a different payload channel 104 corresponding to that program channel from each frame.

Figure 13:
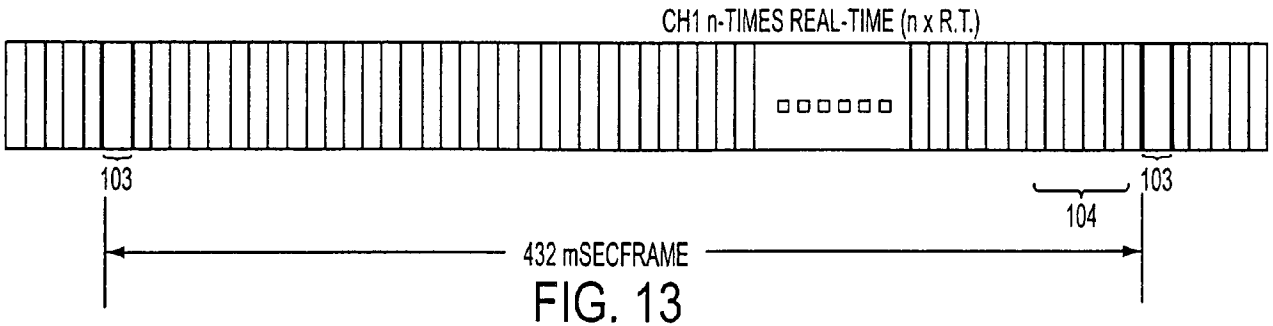
Figure 14:
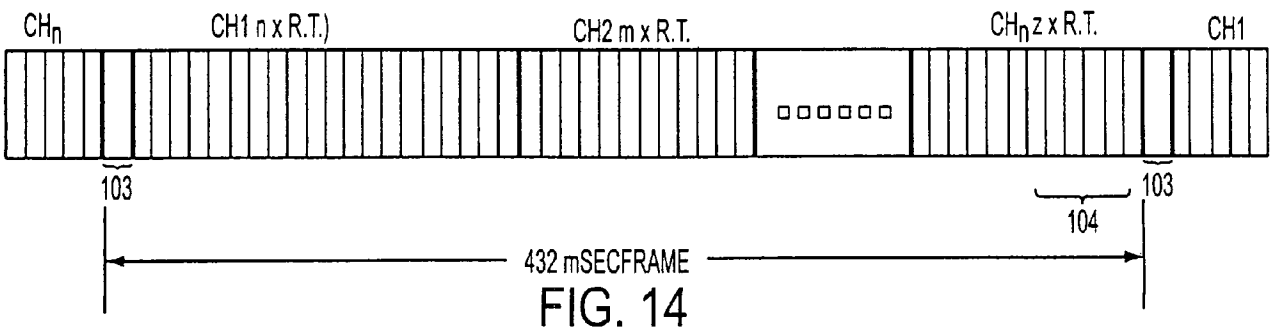

FIGS. 13 and 14 depict respective exemplary embodiments for additional air interface formats. FIG. 12 illustrates a time division multiplex of multiple real-time audio streams. FIG. 13 depicts an air interface for a single channel (e.g., Ch. 1) audio stream that is transmitted faster than real-time. FIG. 14 depicts an air interface for multiple single channel audio streams that are transmitted faster than real-time (e.g., Ch. 1, Ch. 2, . . . , Ch. n that are transmitted, respectively at rates n, m, . . . , z times faster than real-time). As described in connection with FIGS. 4B and 5, a channel transmitted using either of the air interface formats depicted in FIGS. 13 and 14 builds a personalized playlist more quickly that the air interface format depicted in FIG. 12.

Figure 15:
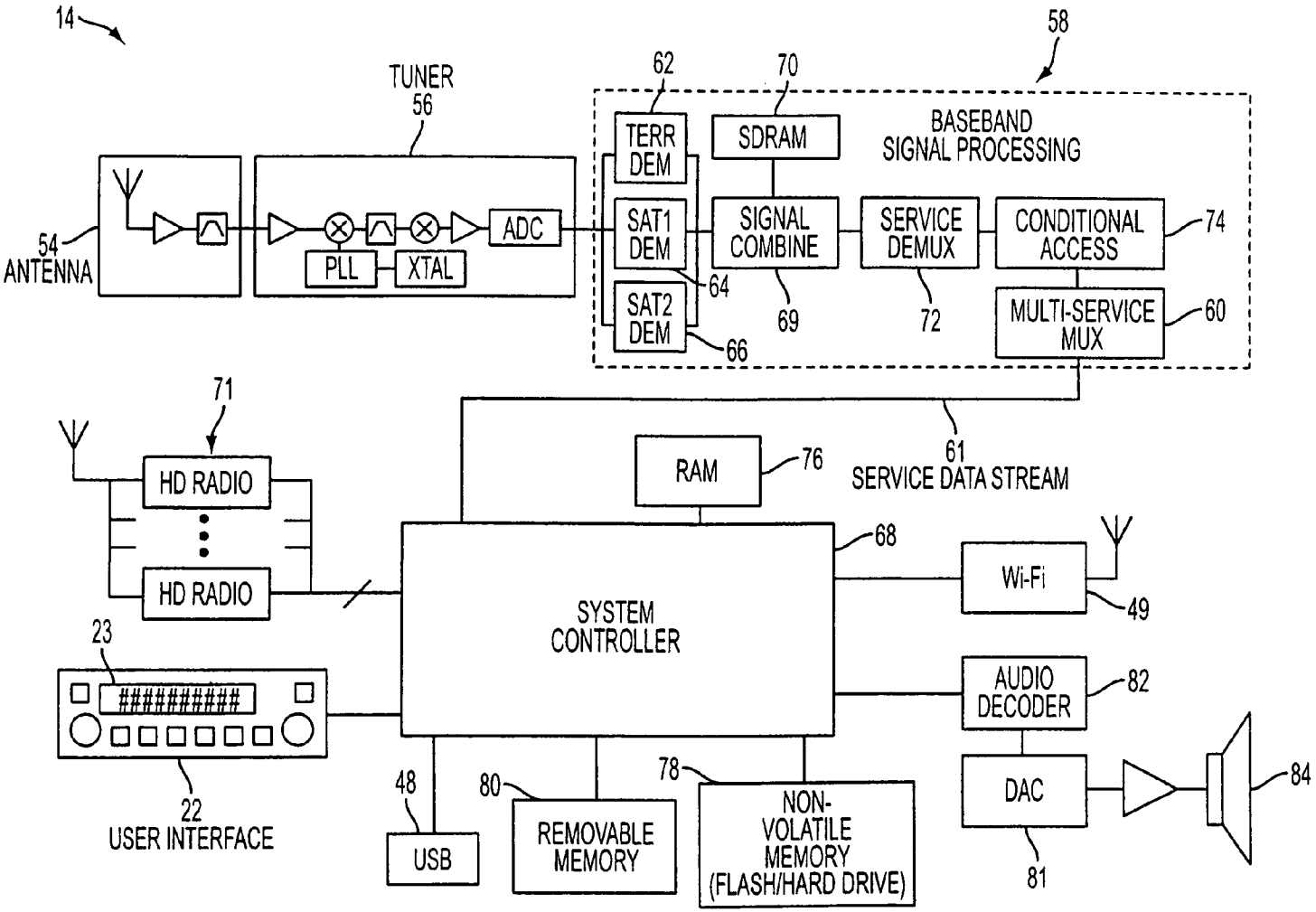
FIG. 15 block diagram of a receiver in accordance with an exemplary embodiment of the present invention.

An exemplary receiver 14 is depicted in FIG. 15. The radio receiver 14 preferably comprises an antenna 54 for receiving, for example, an SDARS signal and/or other broadcast streams, a tuner 56, baseband signal processing components indicated generally at 58, a system controller 68, a multi-service multiplexer MUX 60 and memory, among other components.

With further reference to FIG. 15, the receiver 14 preferably comprises three receiver arms for processing the SDARS broadcast stream received from two satellites 12, 16 and a terrestrial repeater 17, as indicated by the demodulators 62, 64, 66, that are demodulated, combined and decoded via the signal combiner 69 in combination with the SDRAM 70, and demultiplexed to recover channels from the SDARS broadcast stream, as indicated by the signal combining module 69 and service demultiplexer module 72. Processing of a received SDARS broadcast stream is described in further detail in commonly owned U.S. Pat. Nos. 6,154,452 and 6,229,824, the entire contents of which are hereby incorporated herein by reference. A conditional access module 74 can optionally be provided to restrict access to certain demultiplexed channels. For example, each receiver 14 in an SDARS system can be provided with a unique identifier allowing for the capability of individually addressing each receiver 14 over-the-air to facilitate conditional access such as enabling or disabling services, or providing custom applications such as individual data services or group data services. The demultiplexed service data stream 61 is provided to the system controller 68 from a multi-service multiplexer 60. In accordance with an embodiment of the present invention, the radio receiver 14 is provided with a memory (e.g., RAM 76 or 78) or a part of a memory that is a multi-channel memory for buffering the selected received and demultiplexed channels of the currently active personalized radio channel configuration.

The RAM 76 connected to the system controller 68 in FIG. 15 is used for buffering. Also, the system controller 68 may be enabled to provide a second level multiplexer to multiplex content from the satellite multi-service multiplexer, an HD receiver bank 71, a WiFi link 49, removable memory 80 and/or the non-volatile memory 78. Some specific examples include building the playlist from (1) one or more high speed HD radio stream(s), (2) multiple real-time HD radio streams, (3) a combination of high speed and real-time HD radio streams, (4) a high speed WiFi stream, (5) a combination of satellite radio stream(s), HD receiver stream(s), WiFi stream(s) and other wireless streams, or any of the previous source stream configurations in combination with locally stored content segments.

With further reference to FIG. 15, the system controller 68 receives a service data stream 61 from the multi-service MUX 60 and can provide selected, demultiplexed audio, speech and the like to an audio decoder 82 and digital to audio converter (DAC) 81 for playback via a speaker 84. The selected content can be based via user inputs to a user interface 22 as shown. The user interface 22 comprises a display 23 and input devices (e.g., buttons, dials) for selecting received program channels for playback and navigating buffered content in the playlist. For example, a user can opt to select one of the received channels for playback in a default playback mode, or select a personalized radio playback mode and use the display and buttons described with reference to FIGS. 6-8 to navigate and listen to segments from multiple buffered channels available in the playlist stored in the SDRAM based on the current personalized radio configuration.

With continued reference to FIG. 15, the radio receiver 14 can have a USB port 48 to allow settings and other operating data to be transferred between another device and the receiver 14 such as personalized radio multi-channel customization parameters as described above. A removable memory 80 and interface can also be provided such as a micro SD card to allow also transfer personalized radio multi-channel customization parameters, or a cartridge on which other buffered content is stored (e.g., acquired content, MyMusic content) for playback when reception of the live source stream is not available as described in commonly-owned U.S. patent application Ser. No. 11/239,642, filed Sep. 30, 2005. Finally, non-volatile memory 78 and random access memory 76 are preferably provided in the radio receiver 14 for use by the system controller 68 (e.g., for storing program code).

Figure 16:
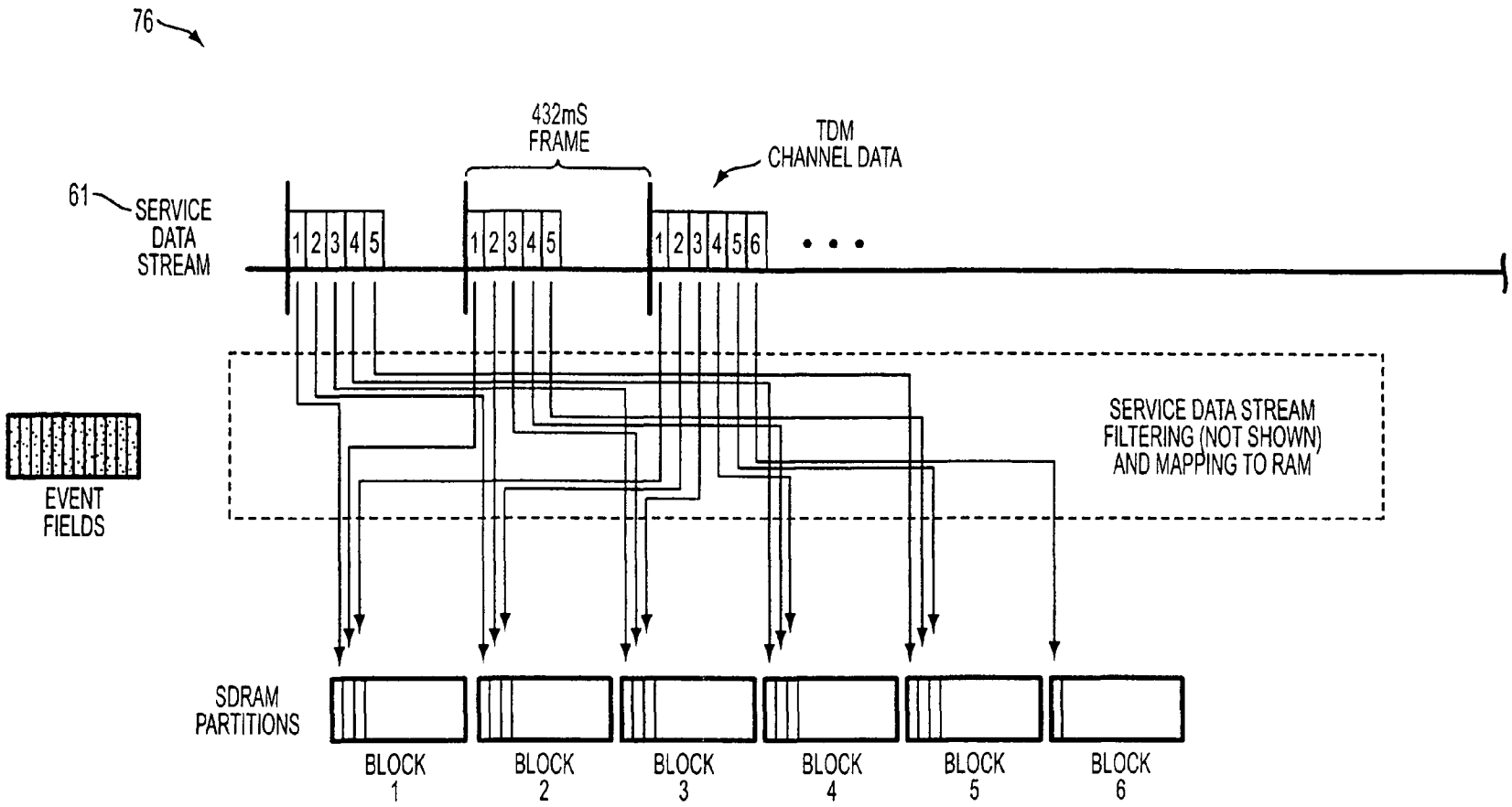
FIG. 16 illustrates buffering management in accordance with an exemplary embodiment of the present invention.

A RAM 76 for providing a multi-channel memory in accordance with an exemplary embodiment of the present invention is shown in FIG. 16 which could be implemented in any R/W memory technology such as a static RAM, SDRAM, DDRAM, embedded RAM or non-volatile memory block. The RAM device 76 is partitioned into 6 dedicated channel blocks indicated in FIG. 16 as Block 1 through Block 6. As frames of source data stream are received, each of 6 channels in a particular personalized radio channel configuration are extracted and mapped to a separate RAM memory block and recorded in circular buffer format, with the exception that buffering shall momentarily halt to prevent overwriting previous content in the active playlist or writing content which is listed on the do-not-play list. Pausing playback of a playlist song is allowed, as well as reverse or backtracking operations (e.g., limited to 3 songs).

Figure 17:
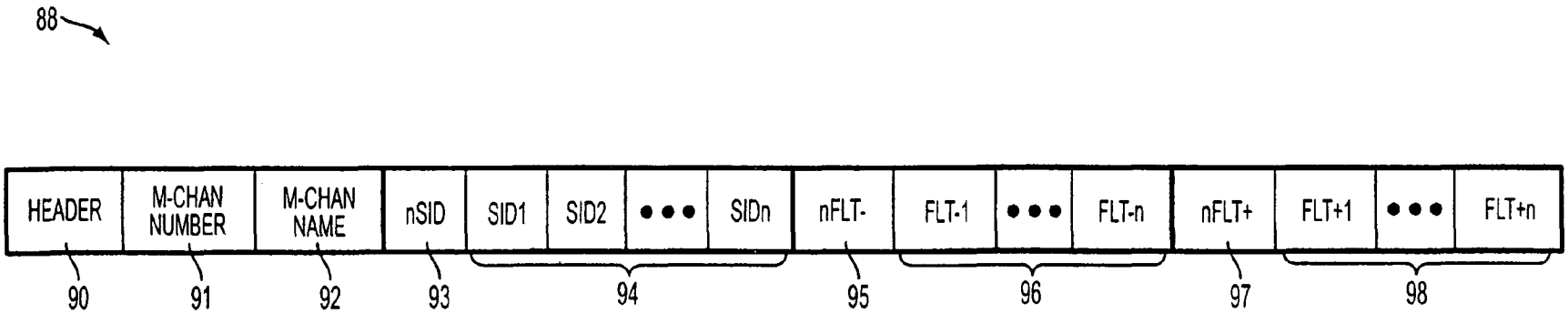
FIG. 17 illustrates a broadcast multi-channel configuration message in accordance with an exemplary embodiment of the present invention.

In accordance with another embodiment of the present invention, predetermined personalized channel configurations can be broadcast to receivers 14 and presented to users to simplify accessibility to the service. BIC messages 88 can have different formats and functions. The BIC can be used, in accordance with an exemplary embodiment of the present invention, to send different personalized channel configurations to receivers 14 (e.g., a different group of preselected channels that constitute a preset personalized channel configuration). An exemplary BIC message 88, that is, a broadcast multi-channel configuration message, is shown in FIG. 17. The broadcast multi-channel configuration message 88 enables the service provider to define tunable presets which contain channel configurations and filters necessary to enable a receiver 14 to automatically configure itself to build a playlist in accordance with the present invention. The receiver 14 receives the broadcast configuration message 88 and enables the subscriber to tune to the configuration by presenting a special multi-channel name and number or genre preset or equivalent in either the normal channel line-up or in a separate category or tuning window. Different multi-channel configurations may be broadcast based on genres, music/talk mixes, and so on. The message 88 can comprise the following fields:

Header 90: a message header identifying the message 88 as a multi-channel definition message;

M-Chan Number 91: the channel number to tune the radio receiver 14 to in order to receive this playlist configuration;

M-Chan Name 92: the name to display for this playlist configuration;

nSID 93: the number n of Service IDs (SID) or channels to simultaneously extract to build this playlist;

SIDx 94: each service listed separately which is to be extracted;

nFLT− 95: the number of specific songs or artists to exclude from the playlist for this configuration FLT−x 96: each specific song or artist listed separately which will be excluded from the playlist (note: this field may be in the form of song/artist IDs or in text format);

nFLT+ 97: the number of specific songs or artists which will be used to search other channels (e.g., if one of these songs or artists are found on another channel, that song or artist will be extracted and added to the playlist); and FLT+x 98: each specific song or artist listed separately for the background channel search (note: this field may be in the form of song/artist IDs or in text format).

Figure 18:
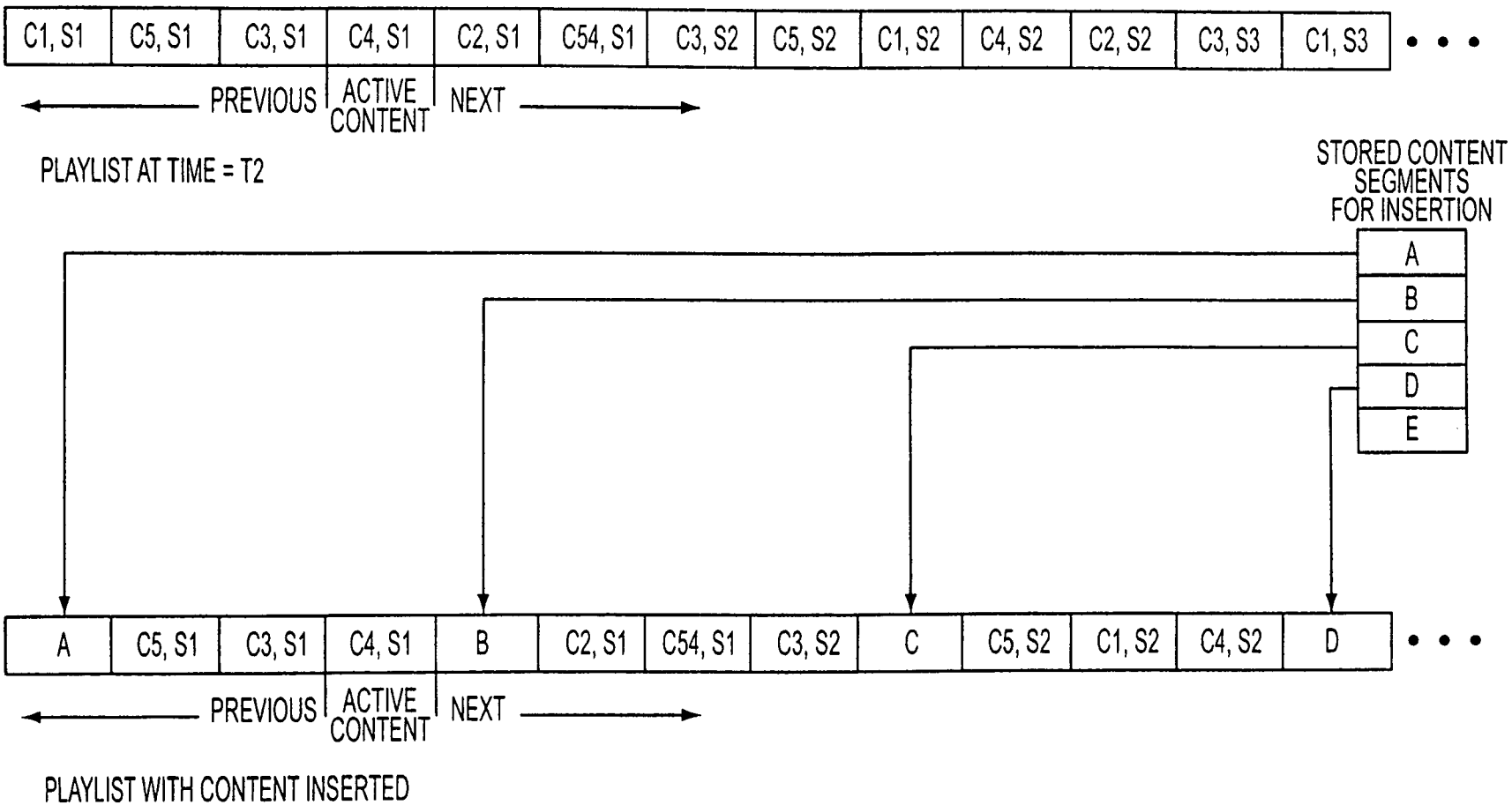
FIG. 18 illustrates personalized radio channel playlist management with content insertion in accordance with an exemplary embodiment of the present invention.

With reference to FIG. 18, in accordance with another embodiment of the present invention, the buffered playlist of a personalized radio channel can be subject to content insertion. For example, a radio receiver 14 can store content segments for insertion among the playlist segments such as commercials. The radio receiver 14 can be programmed to insert selected content insertion segments (e.g., segments A, B, C and D) at selected points among the queued playlist segments. The radio receiver 14 can be programmed to only play the full-length version of the inserted content segment as opposed to the truncated preview version. The radio receiver 14 can also be controlled to limit a user's ability to skip inserted content segments. Such control could be used to limit the ability to skip certain content segments, such as commercials, or to limit the number of skips allowed over a preset period of time.

It is to be understood that the present invention can also be embodied as computer-readable codes on a computer-readable recording medium. The computer-readable recording medium is any data storage device that can store data which can thereafter be read by a computer system. Examples of the computer-readable recording medium include, but are not limited to, read-only memory (ROM), random-access memory (RAM), CD-ROMs, magnetic tapes, floppy disks, optical data storage devices, and carrier waves (such as data transmission through the Internet via wired or wireless transmission paths). The computer-readable recording medium can also be distributed over network-coupled computer systems so that the computer-readable code is stored and executed in a distributed fashion. Also, functional programs, codes, and code segments for accomplishing the present invention can be easily construed as within the scope of the invention by programmers skilled in the art to which the present invention pertains.

While the invention has been shown and described with reference to a certain embodiment thereof, it will be understood by those skilled in the art that various changes in form and details may be made therein without departing from the spirit and scope of the invention. Consequently, the scope of the invention should not be limited to the embodiment, but should be defined by the appended claims and equivalents thereof.

What is claimed is:

1. A method of generating a playlist from one or more received broadcast streams comprising:

receiving, at a receiver, at least one broadcast stream comprising a plurality of multiplexed audio program channels, each of the audio program channels comprising audio segments for reception by all receivers configured to receive the at least one broadcast stream;

selecting, at the receiver, a set of channels from among a plurality of preconfigured sets of channels, the preconfigured sets of channels comprising selected ones of the audio program channels in the broadcast stream;

simultaneously extracting each of the audio program channels in the selected set of channels from the received broadcast stream; and generating a playlist, at the receiver, by multiplexing and storing the audio segments in the extracted set of channels contemporaneously as the extracted set of channels are received.

2. A method as claimed in claim 1, wherein the broadcast stream provides several genres of audio programming and several audio program channels for each of the genres, and the selected set of channels comprises a plurality of audio program channels containing audio segments corresponding to the same genre.

3. A method as claimed in claim 2, wherein the genres of audio programming comprise music genres.

4. A method as claimed in claim 1, wherein the broadcast stream provides several genres of audio programming and several audio program channels for each of the genres, and the selected set of channels comprises a plurality of audio program channels containing audio segments corresponding to at least two genres.

5. A method as claimed in claim 4, wherein the at least two genres are selected from the group consisting of music, news, sports, comedy, and talk shows.

6. A method as claimed in claim 1, wherein generating a playlist comprises listing the audio segments in the extracted set of channels for playback in the order of the respective start times of the audio segments in the broadcast stream.

7. A method as claimed in claim 6, wherein generating a playlist comprises storing the audio segments from the extracted set of channels from their respective start times to allow playback from the beginning of each of these audio segments, and further comprising:

providing a user with navigation control inputs to scroll forward and backward in the playlist to see the currently stored audio segments, and to select and playback the audio segments in the playlist, to expose a user to the audio segments in the extracted set of channels even when they are being presented simultaneously in the received broadcast stream.

8. A method as claimed in claim 7, further comprising automatically playing back the audio segments in the playlist in a preview mode by playing back truncated versions of the audio segments.

9. A method as claimed in claim 8, wherein providing a user with navigation control inputs comprises providing a user with a control input to select and playback a full length version of one of the audio segments.

10. A method as claimed in claim 7, wherein generating a playlist further comprises buffering the multiplexed audio segments on a first in first out (FIFO) basis and writing over the stored audio segments as new audio segments are received via the at least one broadcast stream.

11. A method as claimed in claim 1, wherein generating a playlist comprises:

buffering the audio segments from the extracted set of channels on a first-in-first-out (FIFO) basis; and managing buffer capacity by overwriting the audio segments in the playlist on a FIFO basis using the audio segments in the set of channels that are currently being extracted from the received broadcast stream.

12. A method as claimed in claim 1, wherein generating a playlist comprises:

buffering the audio segments from the extracted set of channels on a first-in-first-out (FIFO) basis; and managing buffer capacity by discarding new audio segments in the set of channels that are currently being extracted from the received broadcast stream when the buffer reaches a predetermined threshold of content waiting to be consumed.

13. A method as claimed in claim 1, further comprising delaying storing of the audio segments into the playlist for a selected period of time following their reception to prevent audio segments comprising any of disc jockey chatter, commercials and undesired content from being stored in the playlist.

14. A method as claimed in claim 1, further comprising not storing an audio segments into the playlist for a selected period of time or for a selected number of audio segments after an equivalent audio segment is determined to already exist in the playlist.

15. A method as claimed in claim 1, further comprising previewing audio segments in the playlist by playing back a truncated version of each of the audio segments.

16. A method as claimed in claim 15, further comprising varying the duration of the truncated versions of the audio segments depending on at least one condition selected from the group consisting of the number of audio segments stored in the playlist, a number of fast forward operations selected by the user during preview, and the rate of the at least one broadcast stream.

17. A method as claimed in claim 15, further comprising displaying titles of the audio segments in the playlist and a countdown timer indicating the amount of time left during playback of a truncated version of one of the audio segments.

18. A method as claimed in claim 15, further comprising:

generating an audible alert at a selected time before the end of playback of a truncated version of one of the audio segments; and providing a user with a control input to select and playback a full length version of the audio segment being played back before the end of its preview.

19. A method as claimed in claim 1, further comprising playing back a full length version of a selected audio segment in response to a user input.

20. A method as claimed in claim 1, wherein receiving the at least one broadcast stream comprises receiving a high speed broadcast stream having a baseband rate that is faster than a real-time baseband audio stream rate.

21. A method as claimed in claim 1, wherein receiving the at least one broadcast stream comprises receiving at least one other stream selected from the group consisting of a satellite radio broadcast stream, a high speed high definition (HD) radio stream, a real-time HD radio stream, a WiFi stream, and wireless stream, the other stream comprising at least one audio program channel having audio segments, and wherein selecting a set of channels comprising an audio program channel from the other stream.

22. A method as claimed in claim 1, further comprising:

displaying at least one of a title, artist and channel identifier for each of the audio segments in the playlist; and providing a user with navigation control inputs to scroll forward and backward in the playlist to see the currently stored audio segments, and to select and playback the audio segments in the playlist.

23. A method as claimed in claim 22, further comprising providing a user with a user control input to select and store one of the audio segments in the playlist to a favorite song file in a non-volatile memory.

24. A method as claimed in claim 1, wherein receiving the at least one broadcast stream comprises receiving a satellite digital audio radio service (SDARS) stream.

25. A method as claimed in claim 24, wherein receiving the at least one broadcast stream further comprises receiving a high definition radio broadcast stream.

26. A method as claimed in claim 1, further comprising selecting a set of channels based on user inputs indicating preferred audio program channels, and extracting the user selected set of channels for generating the playlist.

27. A method as claimed in claim 26, further comprising storing playlist configuration data comprising at least one of a user selected set of channels, and a playlist of audio segments generated using a user selected set of channels.

28. A method as claimed in claim 27, further comprising transferring the playlist configuration data between at least two playback devices.

29. A method as claimed in claim 1, further comprising inserting selected content into the playlist among the audio segments from the extracted set of channels.

30. A method as claimed in claim 29, wherein the selected content comprises commercials.

31. A method as claimed in claim 30, further comprising providing different tiers of subscription service to receive the at least one broadcast stream based on the amount of selected content that is inserted into the playlists.

* * * * *